US010112290B2

(12) United States Patent
Autschbach et al.

(10) Patent No.: US 10,112,290 B2
(45) Date of Patent: Oct. 30, 2018

(54) DEVICE FOR PRESSURE MONITORING

(71) Applicant: Construction Tools GmbH, Essen (DE)

(72) Inventors: Uwe Autschbach, Oberhausen (DE); Stefan Lohmann, Mülheim (DE)

(73) Assignee: CONSTRUCTION TOOLS GMBH, Essen (DE)

( * ) Notice: Subject to any disclaimer, the term of this patent is extended or adjusted under 35 U.S.C. 154(b) by 557 days.

(21) Appl. No.: 14/748,786

(22) Filed: Jun. 24, 2015

(65) Prior Publication Data

US 2015/0375382 A1 Dec. 31, 2015

(30) Foreign Application Priority Data

Jun. 25, 2014 (DE) ..... 10 2014 108 848

(51) Int. Cl.
*E21B 15/04* (2006.01)
*B25D 9/14* (2006.01)
*B25D 9/12* (2006.01)

(52) U.S. Cl.
CPC ..... *B25D 9/145* (2013.01); *B25D 9/12* (2013.01)

(58) Field of Classification Search
CPC E21B 1/00; E21B 34/10; B25D 9/145; B25C 1/04
USPC ..... 173/2, 171
See application file for complete search history.

(56) References Cited

U.S. PATENT DOCUMENTS 3,641,877 A * 2/1972 Hebert ..... F15B 11/12 91/167 R
3,762,160 A * 10/1973 Kramer ..... F15B 11/02 60/537
3,834,382 A * 9/1974 Lederman ..... A61M 16/00 128/204.24
3,879,018 A * 4/1975 Hunter ..... B06B 1/183 366/114
3,935,908 A * 2/1976 Pepe ..... E02D 7/10 173/127
4,103,746 A * 8/1978 Reynolds ..... B25D 9/12 173/107

(Continued)

FOREIGN PATENT DOCUMENTS

DE 25 12 731 A1 10/1976
EP 0 752 297 B1 11/2000
JP 2008114296 A 5/2008

*Primary Examiner* — Robert Long
(74) *Attorney, Agent, or Firm* — McGlew and Tuttle, P.C.

(57) ABSTRACT

A device for monitoring pressure within a gas space, which is filled with gas, preferably nitrogen, and/or is prestressed, of a pressure accumulator of a hydraulically driven percussive mechanism having a housing in which a piston is mounted, together with a display element which extends through the face surface of the housing, so as to be slidingly movable counter to the force of a spring, wherein the piston divides the housing into a pressure chamber and a spring chamber. The spring acts on a spring chamber-side working surface of the piston, and the pressure accumulator is at least indirectly operatively connected to the pressure chamber-side working surface of the piston, such that, in the event of a critical pressure within the pressure accumulator being undershot, the piston and the display element are displaced to such an extent that the display element protrudes out of the housing.

10 Claims, 4 Drawing Sheets

(56) References Cited

U.S. PATENT DOCUMENTS 4,143,585 A * 3/1979 Selsam ..... B25D 9/12 91/276
4,654,643 A * 3/1987 Meisenheimer, Jr. ..... G01L 19/12 116/266
5,408,768 A * 4/1995 Karani ..... B25D 9/145 172/664
5,927,329 A * 7/1999 Yie ..... A62C 31/02 137/624.13
6,032,537 A * 3/2000 McLaren ..... F15B 21/005 73/756
6,510,902 B1 * 1/2003 Prokop ..... E02F 3/966 173/1
7,654,337 B2 * 2/2010 Noel ..... E21B 44/00 173/1
7,669,651 B1 * 3/2010 Carstensen ..... E21B 47/0008 166/105
7,849,869 B2 * 12/2010 Ohmi ..... F16K 47/02 137/14
9,188,500 B2 * 11/2015 Pezzin ..... G01L 23/00
2004/0016586 A1 * 1/2004 Dvorak ..... E02F 3/3604 180/272
2005/0252554 A1 * 11/2005 Partridge ..... F17D 1/20 137/488
2006/0042392 A1 * 3/2006 Janik ..... B01D 35/143 73/715
2007/0125179 A1 * 6/2007 Janik ..... B01D 35/143 73/744
2010/0193212 A1 * 8/2010 Konecnik ..... B25D 9/04 173/218
2011/0000695 A1 * 1/2011 Saf ..... B25D 9/125 173/201
2012/0091382 A1 * 4/2012 Yie ..... F16K 31/3835 251/337
2013/0152572 A1 * 6/2013 Madderno ..... F04B 9/1256 60/413
2015/0027569 A1 * 1/2015 Preuss ..... E02F 5/323 137/557
2015/0034178 A1 * 2/2015 Vasquez ..... G05D 16/0633 137/471
2015/0034184 A1 * 2/2015 Schmitz ..... G01L 19/10 137/544

* cited by examiner

DEVICE FOR PRESSURE MONITORING

CROSS REFERENCE TO RELATED APPLICATIONS

This application claims the benefit of priority under 35 U.S.C. § 119 of German patent application DE 10 2014 108 848.4 filed Jun. 25, 2014, the entire contents of which are incorporated herein by reference.

FIELD OF THE INVENTION

The present invention relates to a device for monitoring the pressure within a gas space, which is filled with a gas, preferably nitrogen, and/or is prestressed, of a pressure accumulator of a hydraulically driven percussive mechanism, in particular of a demolition hammer or of a drilling hammer, having a housing in which a piston is mounted, together with a display element which extends through the face surface of the housing, so as to be slidingly movable counter to the force of a spring, wherein the piston divides the housing into a pressure chamber and a spring chamber.

BACKGROUND OF THE INVENTION

Hydraulically operated percussive mechanisms are used in mounted implements, such as for example hydraulic hammers or drilling hammers, wherein the mounted implements are mounted on carrier vehicles, in particular mobile excavators, and are connected to the hydraulic system thereof via a pressure line and a return line. Percussive mechanisms have a percussive piston which has one or more hydraulic drive surfaces, at least one of which is, by way of a valve, connected alternately to a return line, which is at low pressure, to the tank of the carrier vehicle or via a pressure line, which is at high pressure, to the pump of the mounted implement, such that the percussive piston performs an oscillating movement along its longitudinal axis. During normal operation, at the end of its movement in one movement direction, the percussive piston strikes a tool, wherein the tool is a chisel, an adapter for piledriving or pipe driving, or an anvil arranged between the percussive piston and the tool.

Hydraulically operated percussive mechanisms have, in some cases, a pressure accumulator in the form of a piston accumulator in order to store kinetic energy of the percussive piston. The upper, cylindrical end, situated opposite the tool, of the percussive piston projects into a gas-filled gas space of the pressure accumulator, wherein a seal which bears against the end of the piston prevents an escape of the gas along the percussive piston.

As the piston moves in the direction of the gas space during the return stroke, the end of the piston displaces gas within the gas space, which thus decreases in size, leading to an increase in the gas pressure. The compressed gas exerts a force on the end of the piston, said force increasing as the gas volume decreases in size. Said force is utilized to accelerate the piston in the direction of movement toward the tool.

During operation, there are thus three characteristic piston positions which can be associated with a respective gas pressure. For example, if a hydraulic hammer which has a percussive mechanism is raised or set down horizontally, its percussive piston is situated in the lower rest position, in which the gas pressure in the piston accumulator assumes its lowest value. When the processing of a piece of material using a hydraulic hammer is ended and the operation of the percussive mechanism is stopped, in order to position the hydraulic hammer differently, the percussive piston assumes its rest position. If the chisel is pressed with its tip against material, the chisel is pushed into the housing of the percussive mechanism until it comes to rest against a stop. In this case, the percussive mechanism is pushed in the upward return stroke direction, in the direction of the gas space, and assumes the impact position, wherein the gas pressure in the piston accumulator assumes a value higher than that in the rest position. When the percussive mechanism is activated, the percussive piston is then hydraulically moved further in the return stroke direction until it reaches its upper reversal point, at which the gas pressure assumes its highest value, wherein the position at the upper reversal point is dependent on the usage conditions of the percussive mechanism and the operating pressure and the pressure in the piston accumulator, and may therefore vary.

Owing to leakage along the seals and gas flows through the seal or the diaphragm or bubble diffusion, the gas pressure falls over the course of time. To maintain the effectiveness of the accumulator, it is thus necessary for the fill pressure in the accumulator to be checked at regular intervals and for the accumulator to be replenished with gas if required. For checking the gas pressure, fittings are necessary for the connection of a pressure measurement implement, for example a manometer, to the gas space. Such fittings comprise a hose and a manometer and, for filling and release purposes, also discharge and filling valves, a pressure reduction valve and screw connections in order for the fittings to be connected to a gas storage bottle. On the gas space, there is provided a shut-off valve or a mechanically opening check valve, to which the fittings are connected, and in addition, normally also a sealing closure screw for preventing an undesired escape of gas.

Since, during the operation of the percussive mechanism, the gas pressure in the piston accumulator constantly changes in a manner dependent on the position of the percussive piston, the gas pressure in the piston accumulator must be measured when the percussive piston is in a particular and defined position, which is possible only when the percussive mechanism is deactivated, that is to say when the hydraulic system is unpressurized. To measure the gas pressure, the rest position of the percussive piston is used, as the percussive piston is situated in a geometrically defined position, specifically at the lower stop.

The checking of the gas pressure is time-consuming because, before the measurement, components such as closure screws must be released, screw connections must be made and, after the measurement, the connection must be released again and the closure screw screwed in again.

Failure to carry out regular checks of the gas pressure can result in a drop in the gas pressure, which reduces the effectiveness of the accumulator and impairs the performance of the percussive mechanism and, for example as a result of excessively intense pressure fluctuations, can also lead to damage of components. The fittings and equipment for the checking of the gas pressure must be available for the checking of the gas pressure and must be operational, and the user must be familiar with the use of the fittings.

JP 2008114296 has disclosed a gas pressure indicator device which is arranged on the hydraulic chamber and in the case of which the gas pressure of the pressure accumulator acts directly on a spring-loaded piston which, with increasing gas pressure, is displaced in the direction of the spring. If the piston is displaced, a bar which is connected fixedly in terms of motion to the piston protrudes out of the housing of the indicator and reveals one or more marks, for example in the form of a groove. The higher the gas pressure acting on the piston, the further the piston is displaced, and the further the bar protrudes out of the housing. During the filling of the accumulator, the marking indicates a particular gas pressure. After measurement has been performed, by virtue of a cap being screwed onto the housing of the device, the bar and the piston are pushed in again counter to the pressure of the gas, in order that the piston and the bar do not permanently move owing to the fluctuating gas pressure during operation. To activate the indicator device, the cap must be removed again.

Percussive mechanisms may furthermore have pressure accumulators in the form of a hydraulic accumulator for the purpose of storing pressurized oil of the hydraulic system. The gas space of a hydraulic accumulator is separated from an oil space by way of a separating element in the form of a piston, an elastic diaphragm or an elastic, hose-like or pot-shaped bladder. The oil space is connected to the hydraulic system directly or via a throttle or a valve. In order to check the gas pressure or for filling purposes or in order to release the gas charge, corresponding fittings such as manometers, hoses and pressurized gas bottles can be connected by way of a valve which is connected to the accumulator space. If, in the hydraulic system, an operating pressure prevails which is higher than the fill pressure within the gas space, oil flows into the oil space and displaces the separating element in the direction of the gas space, whereby the oil space is increased in size, the gas space is reduced in size and the gas is compressed, to a pressure corresponding to the pressure of the oil. Thus, when the oil demand of the consumer is low, the oil that is delivered by the pump can be stored in the hydraulic accumulator in order to reduce the pressure increase in the hydraulic system, and when the demand of the consumer is high, oil can be released from said hydraulic accumulator in order to reduce the pressure drop in the hydraulic system. Intense pressure fluctuations and pressure peaks are thus avoided.

In the case of known indicator devices, it has proven to be disadvantageous that the indicator device must firstly be activated by a user by the removal of the cap, such that there is the risk that the user, in failing to adhere to the service intervals, neglects to perform such activation and the percussive mechanism is operated with an excessively low gas fill pressure, whereby the performance of the percussive mechanism is reduced and components are possibly damaged.

Even if the indicator device were always activated by virtue of the cap being left off, and wear of the indicator device were accepted, it would be the case even in the presence of an excessively low gas fill pressure that, during operation, the gas pressure would repeatedly exceed the required gas fill pressure, and the bar would repeatedly emerge from the housing such that the marking or markings would appear, which marking or markings would then at least intermittently indicate an adequate gas fill pressure. If this signal is interpreted incorrectly, an undershooting of the required gas fill pressure will not be noticed, and the percussive mechanism will consequently be operated with an excessively low gas fill pressure, resulting in a reduction in the performance of the percussive mechanism and the risk of damage to components.

Since the length to which the bar protrudes beyond the housing is dependent on the gas pressure and increases with increasing gas pressure up to a maximum structurally limited length, the user must measure the length or take notice of whether one or more markings present on the bar are visible. The reading of the indicator is thus cumbersome and requires knowledge regarding the interpretation of the length or of the markings.

An undershooting of the required fill pressure is not clearly indicated, because during operation of the percussive mechanism, when the percussive piston is situated above the rest position, an adequate gas fill pressure is indicated.

SUMMARY OF THE INVENTION

It is therefore the object of the present invention to propose a device for monitoring the pressure, which device clearly indicates an undershooting of the required gas pressure in a pressure accumulator both while the percussive mechanism is at a standstill and while it is in operation, without the need to perform handling in order to activate the device. Here, the device should output a signal only when the percussive piston is situated in its defined rest position, in which the gas pressure is measured.

The object is achieved by means of the device of the present invention. According to the invention, the spring acts on a spring chamber-side working surface, which is averted from the display element, of the piston, and the pressure accumulator is at least indirectly operatively connected to the pressure chamber-side working surface, facing toward the display element, of the piston, such that, in the event of a critical pressure within the pressure accumulator being undershot, the piston and the display element are displaced to such an extent that the display element protrudes out of the housing. By contrast, in the presence of the desired pressure conditions, the pressure within the pressure chamber of the housing is of such a magnitude that the spring force is not sufficient to push the indicator element out of the housing, such that the piston remains in a rest position regardless of the pressure within the pressure chamber, and the indicator element does not indicate an undershooting of the critical pressure.

In other words, the gas pressure acting in the gas space of the pressure accumulator acts on a first surface of the piston of the indicator device (pressure chamber-side working surface), wherein the first surface is arranged on that side of the piston to which a bar, as a preferred indicator element, is also fastened, such that the gas pressure exerts a force on the piston in the direction in which the bar is retracted into the housing. A spring is arranged on the second surface, which is directed oppositely to the first surface, and imparts a force counter to the gas force. The spring and the piston surface are designed such that, in the presence of an adequate gas fill pressure, the gas force exceeds the spring force and the piston and the bar assume a first, structurally defined position in which the bar is fully retracted into the housing of the indicator device. The gas pressure at which the indicator is intended to output a signal is defined by way of the preload of the spring. If the gas pressure falls below the predefined gas fill pressure defined by the spring force, the piston is displaced by the force of the spring, such that the bar protrudes out of the housing and appears to the user of the percussive device. The spring may for example be a compression spring with coils composed of steel wire, or may be a gas pressure spring which, by way of a gas preload, acts on a second surface situated opposite the first surface. The further the gas pressure falls, the further the bar protrudes out of the housing, until it is stopped by a structurally defined stop.

A device of said type advantageously outputs a signal only when the gas pressure falls below a preset threshold value. This is particularly important because, even if the gas fill pressure was previously correctly set, the gas pressure can fall over the course of time owing to leakages, leading to a reduction in the performance of the percussive mechanism and possibly to damage of percussive mechanism components. Even in the case of a percussive mechanism which is at least intermittently shut down, it is possible from the protrusion of the indicator element to directly identify that the gas fill pressure has fallen below its required value.

Since it is the case that the gas pressure is higher in all positions of the percussive piston, with the exception of the rest position, in which the percussive piston assumes a structurally specified defined position and in which the gas fill pressure is to be measured, than in the rest position, it is the case that, when the required gas fill pressure prevails, a movement of the piston and of the rod during the operation of the percussive mechanism is prevented, thus considerably increasing the service life of the components of the gas pressure indicator.

It is thus always the case that, when the signal appears, the required fill pressure in the pressure accumulator has been undershot, and replenishment of gas is necessary.

The device according to the invention can also be used on hydraulic accumulators.

Preferred refinements of the present invention will be described below.

In a first preferred refinement, it is provided that the display element has at least one marking which, after the undershooting of a critical pressure and the displacement of the display element, appears and signals the undershooting of the critical pressure. It is also possible for multiple axially spaced-apart markings to be provided, the appearance of which represents a measure for the value of the pressure.

In a further preferred embodiment of the present invention, the indicator element is a bar which is connected to the pressure chamber-side working surface of the piston. When the required pressure within the pressure chamber of the housing undershoots a predefined value, the bar protrudes out of the housing owing to the spring force, and thus signals an undershooting of the predefined pressure.

Furthermore, the pressure accumulator is preferably connected directly, via a pressure line, to the pressure chamber-side working surface of the piston. Such an embodiment can be produced at relatively low cost and has the effect that an undershooting of the differential pressure between the pressure accumulator and the spring chamber causes the indicator element to be pushed out of the housing and expose the marking, such that the undershooting of the required pressure is signaled.

Alternatively, in a particularly preferred refinement, it is provided that the pressure chamber of the pressure accumulator is connected to the control surface of a spring-loaded pressure valve which can be transferred from a pass-through position into a blocking position counter to the force of a compression spring, wherein the pressure chamber of the housing is connected via a check valve to the pressure line of the hydraulics and, in the pass-through position, is relieved of pressure to the tank. After the initial activation of the hydraulics, the pressure prevailing in the pressure chamber is the same as that which normally prevails in the hydraulic line, which far exceeds the critical pressure value within the pressure accumulator. In this respect, in the case of this setting of the pressure valve, the indicator element is permanently held in the position in which the indicator element is mounted to the greatest possible extent within the housing. Only when the critical pressure within the pressure accumulator is undershot does the spring-loaded valve switch into the pass-through position, such that the pressure within the pressure chamber flows out, and consequently the low pressure is indicated by the displaced indicator element. In this embodiment, the blocking position may also be replaced by a check valve which is accordingly integrated within the spring-loaded pressure valve, whereby a hydraulic line is advantageously dispensed with.

Finally, the check valve is preferably arranged such that a flow of hydraulic fluid from the pressure line of the hydraulics via the check valve to the pressure chamber is possible, but a return flow from the pressure chamber via the check valve is blocked.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
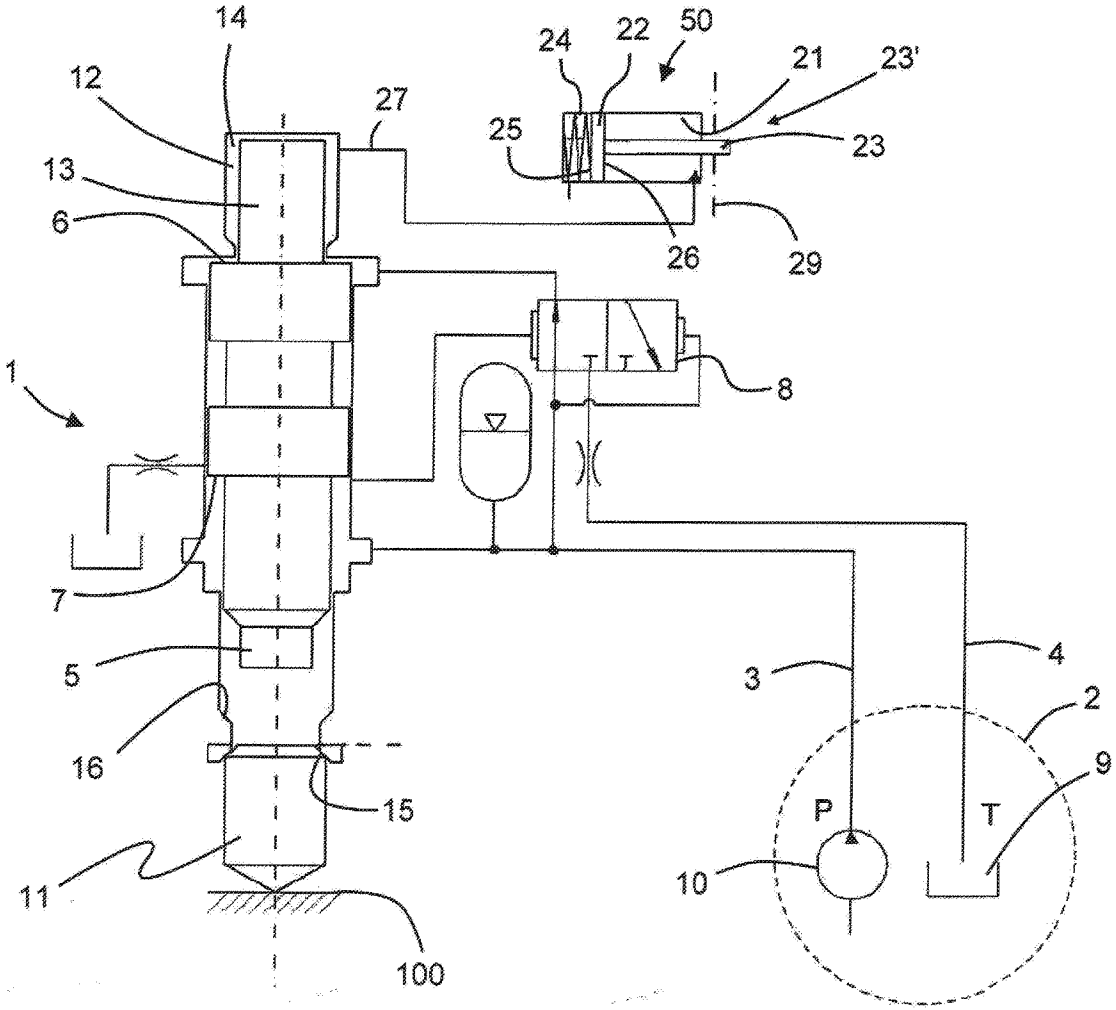
FIG. 1 is a schematic view of a hydraulic percussive mechanism according to a first embodiment.

Hydraulically operated percussive mechanisms 1 are used in mounted implements such as hydraulic hammers, drilling hammers etc., wherein the mounted implements are mounted on carrier vehicles, such as for example mobile excavators, and are connected to the hydraulic system 2 thereof via a pressure line 3 and a return line 4. On the carrier vehicle there is provided a switching valve which can break or establish the connection between the pump of the carrier vehicle and the pressure port of the percussive mechanism and between the tank of the carrier vehicle and the return port, in order to deactivate or activate the percussive mechanism.

Percussive mechanisms have a percussive piston 5 which has one or more hydraulic drive surfaces 6, 7, at least one of which can, by way of a valve 8 associated with the percussive mechanism, be connected alternately to a return line, which is at low pressure, to the tank 9 of the carrier vehicle or via a pressure line, which is at high pressure, to the pump 10 of the mounted implement, such that the percussive piston 5 performs oscillating movements along its longitudinal axis. During normal operation, at the end of its movement in one movement direction, the percussive piston strikes a tool 11, wherein the tool is a chisel, an adapter for piledriving or pipe driving, or an anvil arranged between the percussive piston and the tool.

Hydraulically operated percussive mechanisms have, in some cases, a pressure accumulator 12 in the form of a piston accumulator in order to store kinetic energy of the percussive piston. The upper, cylindrical end 13, situated opposite the tool, of the percussive piston projects into a gas-filled gas space 14 of the pressure accumulator, wherein a seal (not illustrated) which bears against the end of the piston prevents an escape of the gas along the percussive piston.

As the piston moves in the direction of the gas space during the return stroke, the end of the piston displaces gas within the gas space, which thus decreases in size, leading to an increase in the gas pressure. The gas exerts a force on the end of the piston, said force increasing as the gas volume decreases in size. Said force is utilized to accelerate the piston 5 in a direction of movement toward the tool 11.

During operation, there are thus three characteristic piston positions which can be associated with a respective gas pressure. For example, if a hydraulic hammer which has a percussive mechanism 1 is raised or set down horizontally, its percussive piston is situated in the lowermost position, the rest position, in which the percussive piston bears against a piston stop 16 of the percussive mechanism housing and in which the gas pressure in the piston accumulator assumes its lowest value. Every time the processing of a piece of material using a hydraulic hammer is ended and the operation of the percussive mechanism is stopped, in order to position the chisel 11 on a different piece of material 100, the percussive piston assumes said rest position. If the chisel, as illustrated in FIG. 1, is pressed with its tip against material, the chisel is pushed into the housing of the percussive mechanism until it comes to rest against a stop 15. In this case, the percussive mechanism is likewise pushed in the upward return stroke direction, in the direction of the gas space, and assumes the impact position, and the gas pressure in the piston accumulator assumes a value higher than that in the rest position. When the percussive mechanism is activated, the percussive piston 5 is then hydraulically moved further in the return stroke direction until it reaches its upper reversal point, at which the gas pressure assumes its highest value, wherein the position at the upper reversal point is dependent on the usage conditions of the percussive mechanism 5 and the operating pressure and the gas fill pressure in the piston accumulator, and may vary slightly.

The percussive mechanism illustrated in FIG. 1 has a gas pressure indicator device 50, in the case of which the gas pressure, after reaching or undershooting a particular gas fill pressure, outputs a signal by virtue of a bar 23 being deployed out of a housing and protruding beyond the housing surface 29. The bar 23 provides a display element 23'.

The gas pressure indicator device 50, which is composed of a piston 22 guided in movable fashion in a housing equipped with a bore 21, has a bar 23 connected fixedly in terms of motion to the piston and has a spring 24. The piston divides the bore 22 into two chambers, in which in each case one piston surface 25, 26 is situated. A first piston surface 26 (pressure chamber-side working surface) is connected by way of a line 27 to the gas space 14 of the pressure accumulator 12, such that the gas pressure prevailing in the gas space acts on the piston surface 26 and exerts on the piston a gas force which can displace the latter toward the left, in the direction away from the housing surface 29. The space surrounding the second piston surface 25 is either connected to the atmosphere or sealingly closed off and filled with air at low pressure, such that the pressure on said surface does not have a significant influence on the movement of the piston. A spring 24 bears against the (spring chamber-side) working surface 25 of the piston, and exerts on the piston a force acting counter to the gas force.

The surface area of the pressure chamber-side working surface 26 and the force of the spring 24 are configured such that, during the operation of the percussive mechanism, and in the presence of an adequate gas fill pressure in the gas space 14, the gas pressure is sufficient to displace the piston into its left-hand end position and hold it there, in which position the spring length is at its shortest and the bar is retracted into the housing to such an extent that it no longer protrudes beyond the housing surface 29.

Only when the percussive mechanism is deactivated and the percussive piston 5 assumes its lowermost rest position, in which the percussive piston bears against a stop 16 of the percussive mechanism housing and in which the gas pressure is to be measured, does the volume in the gas space assume its greatest value and the gas pressure assume its lowest value within the range of the possible percussive piston movement.

When the percussive piston is situated in the rest position, if the gas pressure is below the predefined target value, the gas force falls below the spring force, whereby the piston is displaced to the right, and the bar 23 is likewise displaced and emerges from the housing and protrudes beyond the housing surface 29. The lower the gas pressure, the further the bar protrudes beyond the housing surface. In the position of the percussive piston illustrated in FIG. 1, it would be necessary, contrary to the illustration, for the bar to be retracted fully into the housing, as the gas pressure always rises in percussive piston positions above the rest position and always lies above the target value when the gas fill pressure is correctly set.

A signal is output to the user, by way of the appearance of the bar, only when the percussive piston is situated in the rest position, in which the gas pressure is to be meaningfully measured and the gas pressure has fallen below the required target pressure.

The risk of the percussive mechanism being operated with an excessively low gas pressure in the accumulator, which can lead to performance losses and damage to the components of the percussive mechanism, is greatly reduced by way of this embodiment, as the signal of the protruding bar is clearly visible to the user, that is to say if the bar appears, the gas fill pressure has fallen below the target value and the gas space must be replenished with gas.

Figure 2A:
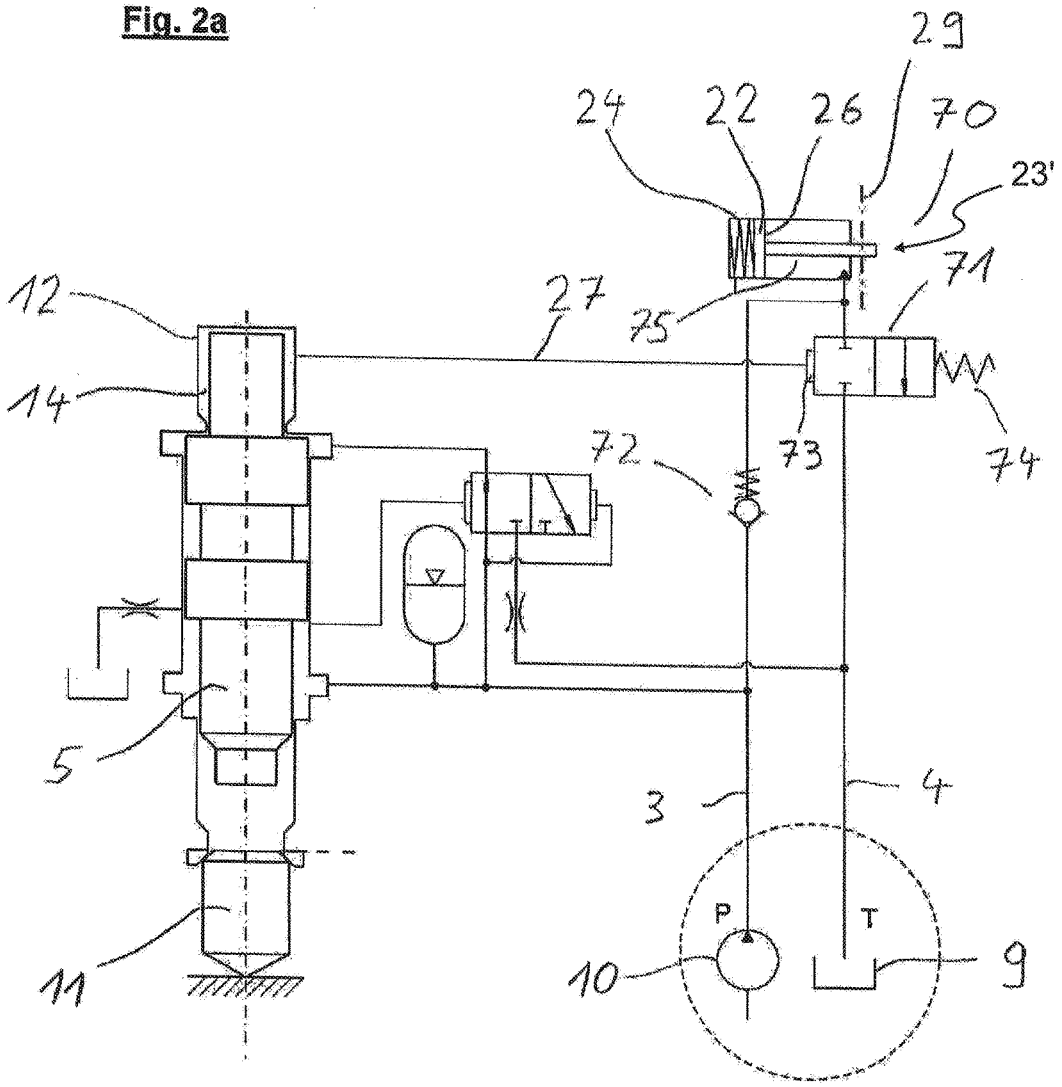
FIG. 2*a* is a schematic view of a hydraulic percussive mechanism according to a second embodiment.

The embodiment of the gas pressure indicator device 70 for a percussive mechanism illustrated in FIG. 2*a* differs from that illustrated in FIG. 1 in that the space 75 in which the first piston surface 26 is situated is not connected to the gas space 14 of the pressure accumulator 12 but is connected by way of two valves 71, 72 either to the pressure line 3 or to the tank line 4 in a manner dependent on the position of the valves. The gas pressure acts via a line 27 on a control surface 73 of a pressure switching valve 71, wherein the pressure switching valve assumes a blocking position when the gas pressure reaches or exceeds the required gas fill pressure. The required gas fill pressure, at which the valve switches into the blocking position, is defined by the force of a spring 74, said force being directed counter to the gas force acting on the control surface 73. The pressure switching valve is connected by way of one port to the space 75 and by way of the other port to the tank line 4. If the valve is situated in the blocking position, as illustrated, the connection between the space 75 and the tank line is blocked, and oil cannot flow out of the space 75 to the tank 9. A check valve is arranged between the space 75 and the pressure line 3 such that pressurized oil can flow from the pressure line via the check valve into the space 75, that is to say onto the surface 26, but not in the opposite direction.

If, by activation of the pump 10, the percussive mechanism is supplied with pressurized oil via the pressure line 3, the percussive piston performs repeated working cycles and impacts against the tool 11. Oil flows out of the pressure line via the check valves 72 into the space 75 and exerts on the piston 22 an oil force which opposes the spring force. The spring is configured such that the oil force exceeds the spring force and the piston is displaced to the left into the initial position, such that the spring is compressed and the bar connected to the piston likewise moves to the left, and the right-hand end of the bar no longer protrudes beyond the housing surface 29 and is no longer visible. If the gas fill pressure in the gas space 14 corresponds to or is higher than the required gas fill pressure, the pressure switching valve assumes the blocking position and the oil cannot flow out of the space 75, that is to say the piston and the bar remain in the initial position, in which the bar is not visible. Only if the gas pressure undershoots the required gas fill pressure is the pressure switching valve switched into the pass-through position, allowing oil to flow out of the space 75 to the tank via the pressure switching valve. This has the result that the pressure in the space 75 falls, and the spring force of the spring 24 displaces the piston and the bar to the right, whereby the bar protrudes beyond the housing surface 29 and appears, which signals to the operator that the gas fill pressure has been undershot. At the same time, with correspondingly large dimensioning of the lines and of the valves, pressurized oil can flow out of the pressure line via the check valve and the pressure switching valve to the tank, such that the pressure in the pressure line falls to such an extent that the percussive mechanism comes to a standstill and no longer imparts a percussive action. In this way, operation with an excessively low gas fill pressure is prevented. The pressure switching valve may be equipped with a seat valve, preferably with an integrated check valve, such that in the blocking position, the connection between the space 75 and the tank is shut off in a leakage-free manner. In this way, the indicator, that is to say the piston 22 and the bar 23, would maintain their position for as long as the gas pressure does not undershoot the target value, even over a relatively long period of time. The control surface 73 on the pressure switching valve is sealed off by way of a seal or elastic diaphragm such that no gas can escape from the system via the control surface.

Figure 2B:
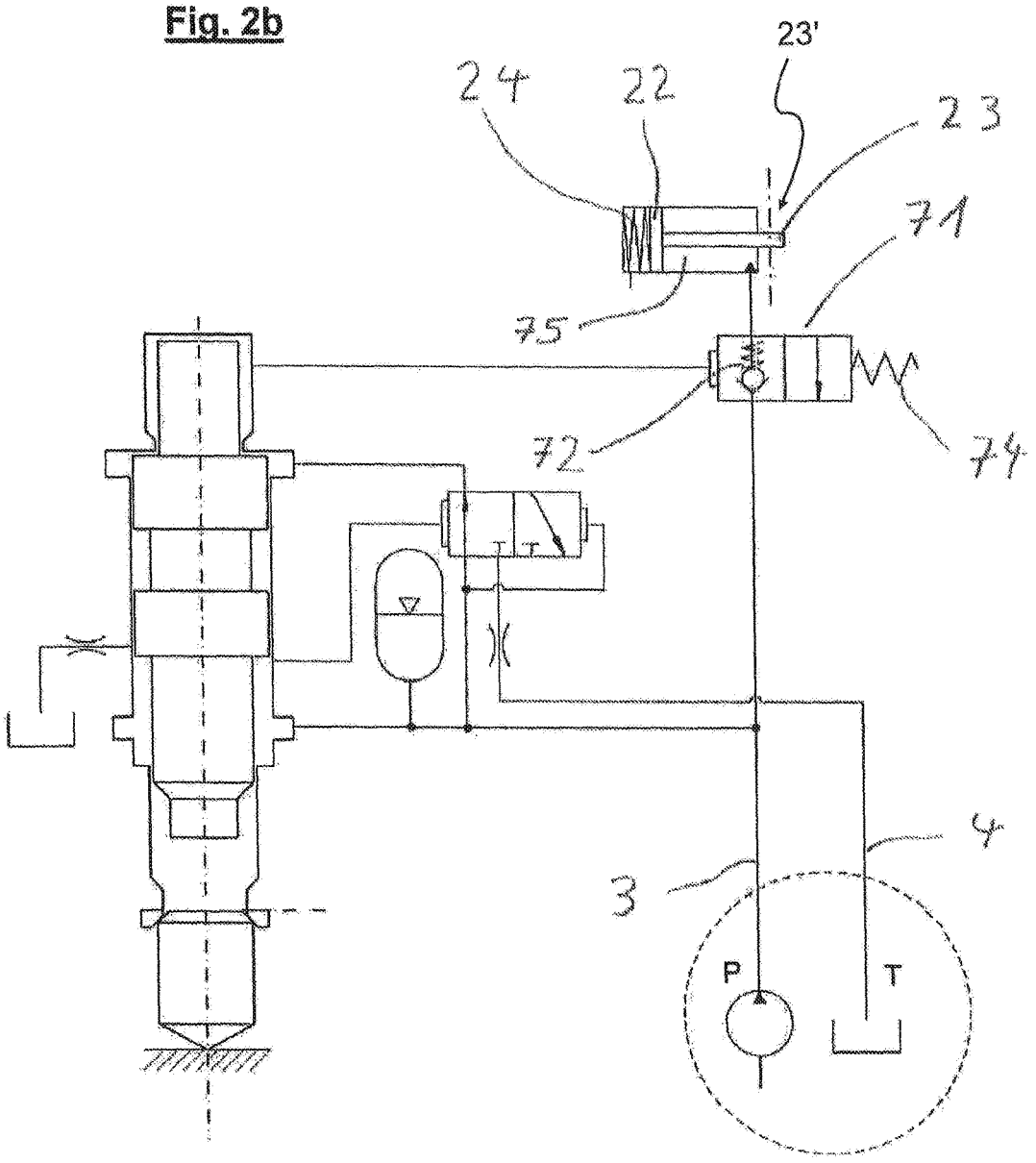
FIG. 2*b* is a schematic view of a hydraulic percussive mechanism according to a second embodiment.

As an alternative to the embodiment as per FIG. 2*a*, it is possible, as illustrated in FIG. 2*b*, for the pressure switching valve 71 to be connected to the pressure line 3 rather than to the tank line 4. When the percussive mechanism is deactivated, which is necessary in order to bring the percussive piston into the lowermost position, which is required for the measurement of the gas pressure, the pressure line is unpressurized owing to the pump-side valve controller (not illustrated) or as a result of leakage at said controller, such that in this state, oil can flow out of the space 75 when the pressure switching valve has been switched into the open position as a result of undershooting of the required gas fill pressure. When oil flows out of the space 75 by the pressure switching valve, the spring 24 displaces the piston 22 and the bar 23 to the right, whereby a signal is output to indicate that the gas fill pressure has been undershot.

Furthermore, the check valve 72, which is arranged between the space 75 and the pressure line, is integrated into the pressure switching valve 71 such that, in the illustrated blocking position, when the percussive mechanism is deactivated and the pressure line is unpressurized, no oil can flow out of the space 75 to the pressure line, but during the operation of the percussive mechanism, when measurement of the gas pressure is not expedient, oil can flow out of the pressure line into the space 75 in order to displace the indicator into its initial position, in which the piston and bar assume their left-hand position.

The gas pressure acts on the piston of the indicator no longer directly but indirectly, and controls the pressure switching valve, which defines the end position of piston and bar. The piston and the bar no longer assume intermediate positions but can assume only two positions, specifically the initial position, in which the piston and bar are displaced to the left, and the signal position, in which the bar protrudes beyond the housing surface and is clearly visible, as a change in gas pressure to a level above a threshold value no longer directly leads to a corresponding displacement of the piston and of the bar. If the gas pressure exceeds the required gas fill pressure, the pressure switching valve switches and leads to a considerable decrease in pressure in the space 75, triggering the displacement of the piston and of the bar from one position into the other position.

Figure 3:
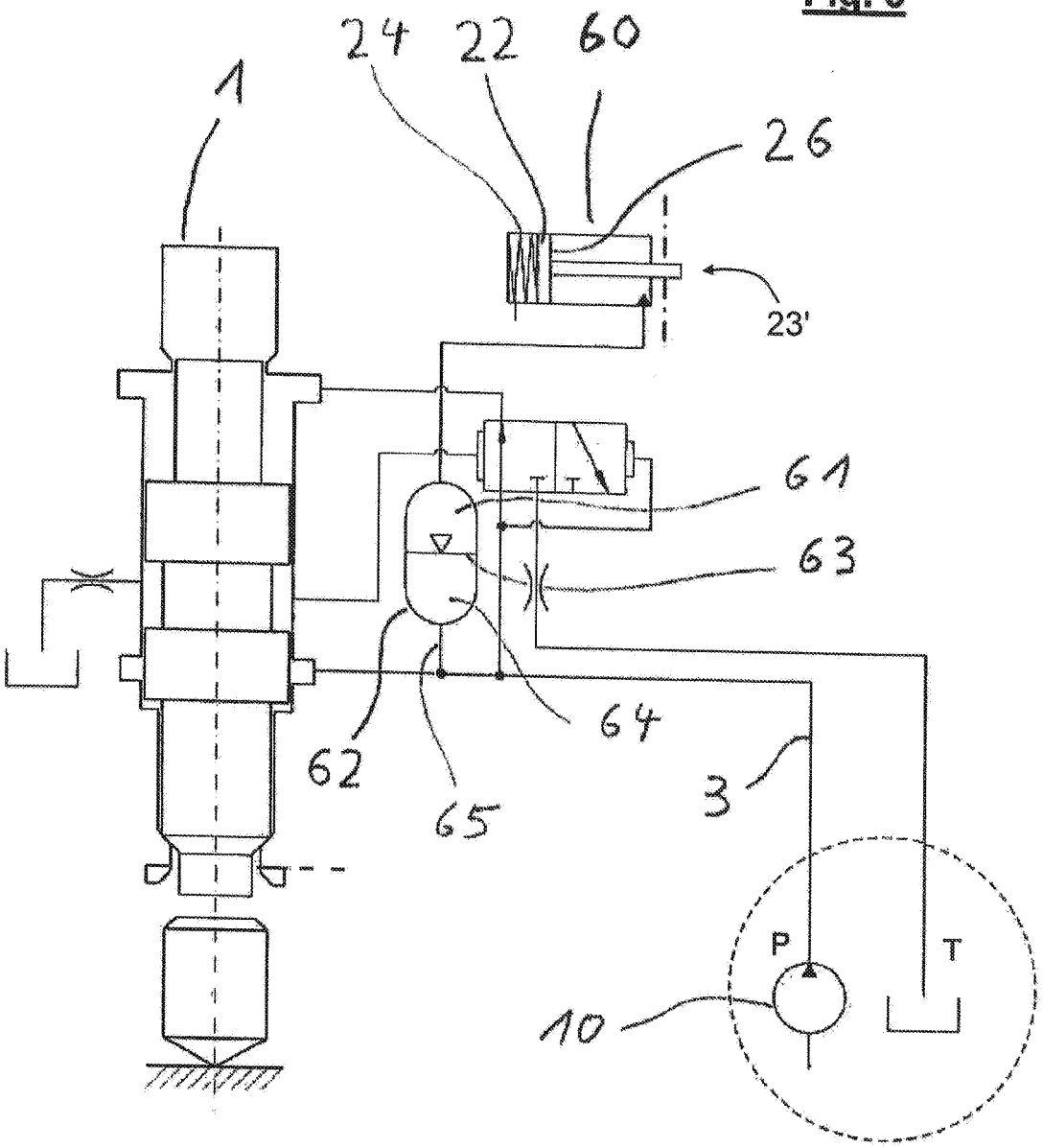
FIG. 3 is a schematic view of a hydraulic percussive mechanism according to a third embodiment.

The percussive mechanism illustrated in FIG. 3 is equipped with a gas pressure indicator device 60 which differs from the embodiment illustrated in FIG. 1 in that the surface 26 of the piston 22 is connected to the gas space 61 of the hydraulic accumulator 62. The hydraulic accumulator can store pressurized oil of the hydraulic system. The gas space of the hydraulic accumulator is separated from an oil space 64 by way of an elastic separating element 63. The oil space is connected to the pressure line 3 directly or indirectly via a throttle or a valve and a line 65. For filling purposes or in order to release the gas charge, corresponding fittings such as for example hoses and pressurized gas bottles can be connected to the gas space 61 by way of a valve which is connected to the gas space. If an operating pressure higher than the gas pressure within the gas space prevails in the pressure line, oil flows into the oil space and displaces the separating element in the direction of the gas space, whereby the volume of the oil space is increased and that of the gas space is decreased. In this way, the gas is compressed up to a pressure which corresponds approximately to the pressure of the oil. Thus, when the oil demand of the percussive mechanism 1 is low, the oil that is delivered by the pump 10 can be stored in the hydraulic accumulator in order to reduce the pressure increase in the pressure line, and when the demand of the percussive mechanism is high, oil can be released from said hydraulic accumulator into the pressure line in order to reduce the pressure drop in the pressure line. Intense pressure fluctuations and pressure peaks in the pressure line are thus prevented, performance is increased owing to the more constant operating pressure, and damage to components owing to intense pressure changes is prevented.

If the percussive mechanism has been deactivated and pressure built up by the pump 10 no longer prevails in the pressure line 3, it is also the case that pressure no longer prevails in the oil space 64 of the accumulator, and the gas pressure displaces the separating element downward, toward the oil space, until the gas space has assumed its maximum possible volume and the oil space has assumed its minimum possible volume. In this state of the hydraulic accumulator, the gas fill pressure of the gas space can be measured. If an adequate gas pressure (target fill pressure) prevails in the gas space, the gas pressure effects a gas force acting on the surface 26 of the piston. The surface 26 and the spring 24 arranged on the opposite side of the piston, which spring generates a spring force opposed to the gas force, are configured such that the gas force compresses the spring to such an extent that the piston assumes its right-hand end position, in which the piston is fully retracted into the housing. If the gas pressure were to lie below the required target gas fill pressure, the spring force would exceed the gas force generated by the gas, and the piston would be displaced to the right, such that the bar is deployed out of the housing and appears clearly to the user, thus signaling to the user that the required gas fill pressure has been undershot and replenishment of gas is necessary. Since the gas fill pressure is lower than the oil pressure prevailing in the pressure line during the operation of the percussive mechanism, it is the case that, during operation, oil flows into the oil space, displaces the separating element and thus reduces the volume of the gas space, whereby the gas pressure increases to approximately the level of the oil pressure. In the presence of adequate gas fill pressure, the piston and the bar remain in their left-hand end positions during operation. The pressure indicator devices as per FIGS. 1, 2*a* and 2*b* may, like that in FIG. 3, be used for monitoring the gas fill pressure of a hydraulic accumulator.

The gas pressure indicator device may be arranged directly on the housing of the percussive mechanism or on a component connected to the housing of the percussive mechanism, such as a valve block, or on the accommodating housing surrounding the percussive mechanism.

The gas space or those components of the gas pressure indicator device which are connected to the gas space of the accumulator may be equipped with valves and connection means in order for a manometer or other pressure indicator devices for determining the gas pressure to additionally be connected, or in order for the gas pressure to be reduced or released through a discharge of the gas or for the gas pressure to be increased through a supply of gas into the gas space. Said valves and connections are not illustrated in the exemplary embodiments but are known from known filling and testing devices for pressure accumulators of percussive mechanisms.

The bar may be equipped with several markings which denote different gas pressures.

Since, in the case of a constant volume, the gas pressure changes with changing gas temperature, the bar may have provided on it multiple markings which denote the attainment of the target gas pressure at different temperatures. In this way, it is possible for the gas pressure to be indicated even in the presence of gas temperatures which deviate from a predefined measurement temperature that is to be adhered to.

The position of the bar of the piston may be detected by way of electronics components for the purposes of triggering a signal, via an electrical signal transmission means, to other locations, for example to the carrier vehicle, or for the purposes of intervention into the hydraulic control of the percussive mechanism such that, in the event of undershooting of the target gas pressure, the hydraulic supply to the percussive mechanism is shut off or the operation of the percussive mechanism is stopped by intervention into the hydraulic control.

Contrary to the embodiments described above, in which, in the right-hand end position of the piston, the bar is fully retracted into the housing and is not visible to the user, the indicator may also be designed such that, in said end position, a part of the bar protrudes beyond the housing surface but said part is distinguished, by way of a marking, so as to clearly differ from that region of the bar which additionally appears when the piston and the bar are moved to the right in the direction of the other end position.

While specific embodiments of the invention have been shown and described in detail to illustrate the application of the principles of the invention, it will be understood that the invention may be embodied otherwise without departing from such principles.

What is claimed is:

1. A device for monitoring a pressure, the device comprising:

a hydraulically driven percussive mechanism comprising a pressure accumulator, the pressure accumulator having a gas space;

a piston;

a display element;

a spring; and a housing, at least a portion of the piston being mounted in the housing such that the piston is slidingly movable counter to a force of the spring, wherein the display element is connected to the piston such that the display element extends through a face surface of the housing, wherein the piston divides the housing into a pressure chamber and a spring chamber, the spring acting on a spring chamber-side working surface of the piston, and the pressure accumulator is indirectly operatively connected to the pressure chamber-side working surface of the piston, such that, in an event of a critical pressure within the pressure accumulator being undershot, the piston and the display element are displaced to such an extent that the display element protrudes out of the housing, the spring chamber-side working surface being averted from the display element, the pressure chamber-side working surface facing toward the display element, the pressure chamber of the pressure accumulator being connected to a control surface of a spring-loaded pressure valve which can be transferred from a pass-through position into a blocking position counter to a force of a compression spring, the pressure chamber of the housing being connected via a check valve to the pressure line of the hydraulics and the pressure chamber of the housing is relieved of pressure to a tank in the pass-through position.

2. A device according to claim 1, wherein the display element has at least one marking which, after the undershooting of the critical pressure and displacement of the display element, appears and signals the undershooting of the critical pressure, the spring being located on one side of the piston, the hydraulically driven percussive mechanism being connected to the housing via a pressure line, the pressure line being connected to the housing at a housing location, the housing location being located on another side of the piston.

3. A device according to claim 2, wherein the display element has axially spaced-apart markings, wherein an appearance of said axially spaced-apart markings represents a measure for a value of the pressure.

4. A device according to claim 1, wherein the check valve is integrated in the spring-loaded pressure valve.

5. A device according to claim 1, wherein the check valve is arranged such that a flow of hydraulic fluid from the pressure line of the hydraulics via the check valve to the pressure chamber is possible, wherein a return flow from the pressure chamber is blocked via the check valve.

6. A device for monitoring a pressure, the device comprising:

a hydraulically driven percussive mechanism comprising a pressure accumulator, the pressure accumulator having a gas space;

a piston;

a display element;

a spring; and a housing, at least a portion of the piston being mounted in the housing such that the piston is slidingly movable counter to a force of the spring, wherein the display element is connected to the piston such that the display element extends through a face surface of the housing, wherein the piston divides the housing into a pressure chamber and a spring chamber, the spring acting on a spring chamber-side working surface of the piston, and the pressure accumulator is indirectly operatively connected to the pressure chamber-side working surface of the piston, such that, in an event of a critical pressure within the pressure accumulator being undershot, the piston and the display element are displaced to such an extent that the display element protrudes out of the housing, the spring chamber-side working surface being averted from the display element, the pressure chamber-side working surface facing toward the display element, the pressure accumulator being connected to a control surface of a spring-loaded pressure valve which can be transferred from a pass-through position into a one-way blocking position counter to a force of a compression spring, wherein the pressure chamber of the housing is relieved of pressure to a tank in the pass-through position and the pressure chamber of the housing is connected via a check valve to the pressure line of the hydraulics in the one-way blocking position.

7. A device according to claim 6, wherein the display element has at least one marking which, after the undershooting of the critical pressure and displacement of the display element, appears and signals the undershooting of the critical pressure, the spring being located on one side of the piston, the hydraulically driven percussive mechanism being connected to the housing via a pressure line, the pressure line being connected to the housing at a housing location, the housing location being located on another side of the piston.

8. A device according to claim 7, wherein the display element has axially spaced-apart markings, wherein an appearance of said axially spaced-apart markings represents a measure for a value of the pressure.

9. A device according to claim 6, wherein the check valve is integrated in the spring-loaded pressure valve.

10. A device according to claim 6, wherein the check valve is arranged such that a flow of hydraulic fluid from the pressure line of the hydraulics via the check valve to the pressure chamber is possible, wherein a return flow from the pressure chamber is blocked via the check valve.

* * * * *